US005184477A

United States Patent [19]

Brown et al.

[11] Patent Number: 5,184,477

[45] Date of Patent: Feb. 9, 1993

[54] PORTABLE CART A COOLER

[76] Inventors: J. Edward Brown, 4297 Minmore Dr., Cincinnati, Ohio 45217; Jenny Ciaccio, 9 Burnham Woods La., Amelia, Ohio 45102

[21] Appl. No.: 767,875

[22] Filed: Sep. 30, 1991

[51] Int. Cl.[5] ..... F25D 3/08

[52] U.S. Cl. ..... 62/457.7; 280/43.1; 62/457.1; 190/18 A; 190/115

[58] Field of Search ..... 62/457.7, 457.1; 280/47.26, 47.17, 43.1, 47.30, 47.31, 47.32, 655, 655.1, 47.315; 190/115, 18 A, 1

[56] References Cited

U.S. PATENT DOCUMENTS 4,460,188 7/1984 Maloof ..... 280/47.26
4,724,681 2/1988 Bartholomew et al. ..... 62/457.7
4,846,493 7/1989 Mason ..... 280/655
4,873,841 10/1989 Bradshaw et al. ..... 62/457.7
4,921,305 5/1990 Steer ..... 280/47.315

*Primary Examiner*—John Sollecito

[57] ABSTRACT

The portable cart a cooler is made by having a vinyl roller on one of its carry handles. There are two roller handle stops or locks that are in the walls of the cooler body, they are on direct opposite sides from each other. They allow for the locking of the roller handle in position for the carting or towing feature of this invention. The pull or tow handle of the cooler is longer in length than the roller handle to allow user to walk in an upright position and to keep cooler from striking users heels when towing. As stated earlier ordinary portable coolers, ice chests do not have the features of this cart a cooler invention, therefore the cart a cooler could be classified a new and useful improvement over older objects considered to be portable coolers, ice chests.

1 Claim, 2 Drawing Sheets

PORTABLE CART A COOLER

BACKGROUND OF THE INVENTION

This invention is directed to portable coolers and ice chest that is an improvement over coolers and ice chests known heretofore.

Coolers are well known in the form of boxes with a lid and usually two handles for carrying, by one or two persons. When they are loaded they are usually heavy and awkward to carry, can cause a user to strain their back, or request someone to help carry the cooler, which can be inconvenient at times. Sometimes a user must limit what they put into the cooler to lighten it for carrying.

SUMMARY

The object of our invention is to provide a portable cooler that is cartable, as well as being carryable, giving a user the option in transporting it across terrain of all types with ease. Another object of our invention is to provide a cartable cooler that can readily be adapted to the present manufactureing of cooler with only a minor change in these methods of building them. Allowing for their mass production inexpensivily.

THE PRIOR ART

When using a portable cooler it is usually moved to the area of its use by carrying it by one or two persons. It is usually heavy with its contents and can cause a person to injure their back. If user has a back injury limitation already they may not be able to use a cooler at all. There is a need for a cooler that is cartable such as out invention. It will prevent injuring a back, and also make it possible for the user that has a back condition to protect their injury. It will also allow for just one person to transport the cooler, if no help is available.

BRIEF DISCRIPTION OF THE DRAWINGS

DESCRIPTION OF THE PREFERRED EMBODIMENT

Figure 1:
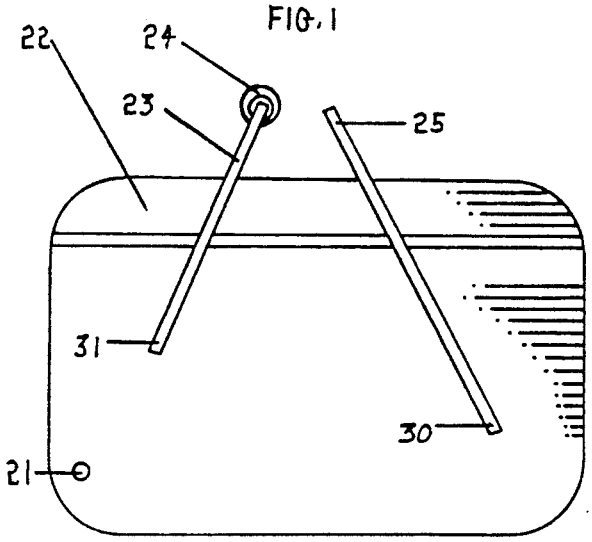
FIG. 1 is a view in front elevation of the preferred embodiment of our invention in cartable coolers.
Figure 2:
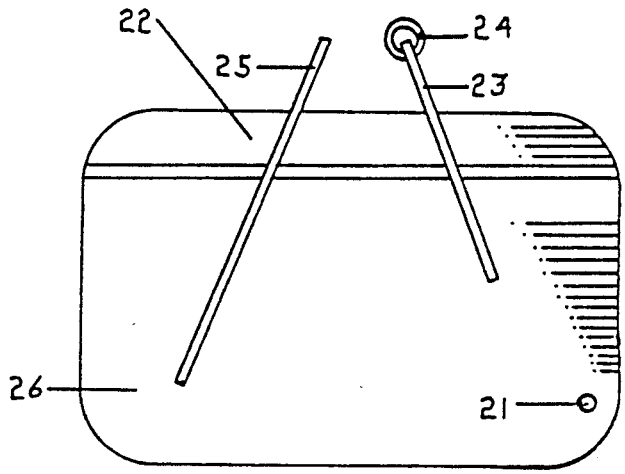
FIG. 2 is a rear view in elevation of the cartable cooler shown in FIG. 1.
Figure 4:
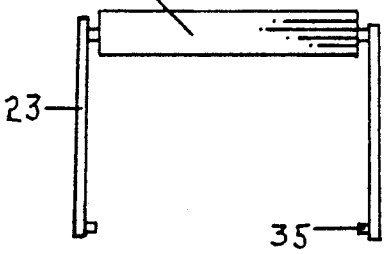
FIG. 4 is a view in front elevation partly in section of the roller handle of the cooler.
Figure 3:
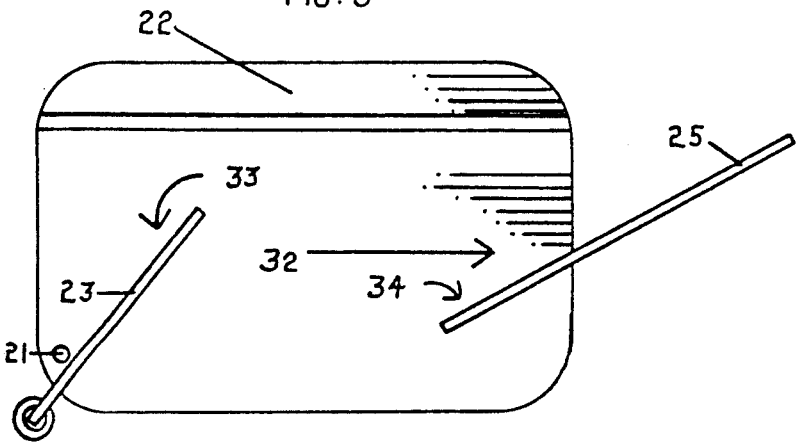
FIG. 3 is a view in front elevation of the cooler in its carting position.
Figure 5:
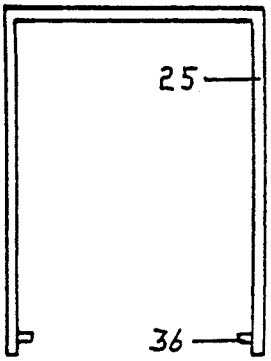
FIG. 5 is a view in front elevation of the towing handle of the cooler.

FIGS. 1, 2, and 3, illustrate the preferred embodiment of this invention, a cartable cooler wherein it is generally indicated at 20. The cartable cooler is comprised of a cooler chest including a body having a generally rectangular bottom member, four upright side walls, and a lid 22 covering the chest across the top, defining an enclosure for containing ice and/or consumable products to be kept cool. A roller handle 23 has protrusions 35 extending from a first end for connection to the chest at coaxial pivot points 31, located on the side walls 20 26 of the chest, which define a roller handle axis of rotation. The roller handle has a roller 24 which covers and is rotatable about a section of the handle, located at a second end, parallel to the roller handle axis of rotation. A tow handle 25 has protrusions 36 extending from a first end for connection to the chest at a second pair of coaxial pivot points 30, located on the side walls 20 26 of the chest, which define a tow handle axis of rotation.

Figure 6:
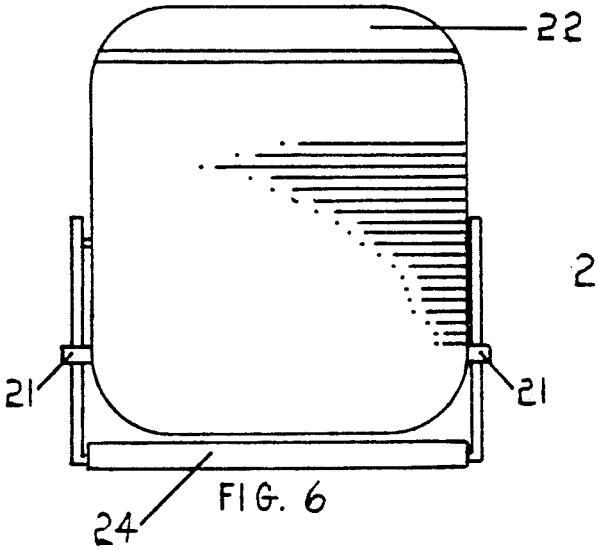
FIG. 6 is a view in side elevation of the cooler showing the roller handle locked in its cart position.
Figure 7:
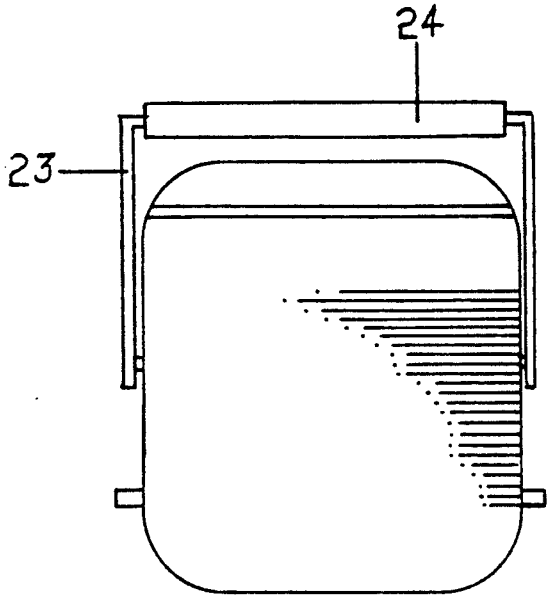
FIG. 7 is a view in side elevation of the cooler showing the roller handle unlocked and in its up to carry position.

The roller handle is rotatable 33 about the roller handle axis of rotation from an upper carrying position (FIGS. 1, 2 & 7) to a lower wheeled towing position (FIGS. 3 & 6), and the tow handle is rotatable about the tow handle axis of rotation from an upper carrying position (FIGS. 1 & 2), in which a second end of said tow handle is brought together with a the second end of the wheeled handle in its upper carrying position, to an extended towing position (FIG. 3). A lock assembly is located on each of the opposing side walls below the roller handle pivot points. The locks are biased to the lock position by spring 28 and operable to support the roller handle 23 in its lower position thereby supporting said wheeled cooler apparatus allowing it to be pivoted about said the second end of said roller handle 23 by raising the tow handle 25.

Figure 12:
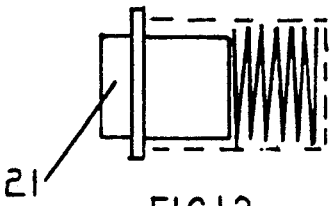
FIG. 12 is a view in side elevation of the roller handle lock (detent) in its to unlock position.

The roller handle 23 may be made from vinyl or metal tubing, it has a roller 24 that may be made from vinyl. The handle 23 acts as a bearing for the roller 24. The center hole 27 in roller 24 is slightly larger in diameter than the diameter of the handle 23, allowing it to turn freely. To put the roller handle 23 in its tow position, user rotates it down in direction 33, while holding locks 21 in, by pushing them direction 29 to their unlock position (FIG. 12). When handle 23 is under the cooler the user simply releases the locks 21, and being spring loaded they will return to the lock position. User then taking hold of handle 25, lifts cooler slightly and tows in direction 32.

To return the cooler to its carry mode, user simply pushes in the locks 21 (FIG. 12), and swings the handle 23 up to its carry position (FIG. 1). User swings the tow handle 25 up to its carry position (FIG. 1). The tow handle 25 being longer in length so that it does not allow cooler to hit users heels when towing, will center with roller handle 23 for balance when in the carry mode. This is attained by the handle 25 being mounted in a lower position on the cooler body 20, than the roller handle 23.

Figure 8:
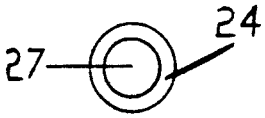
FIG. 8 is an end plan view of the roller.
Figure 9:
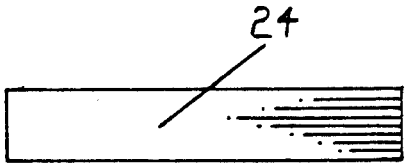
FIG. 9 is a top plan view of the roller.
Figure 11:
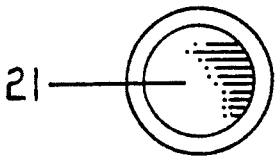
FIG. 11 is an end plan view of the roller handle lock (detent)
Figure 10:
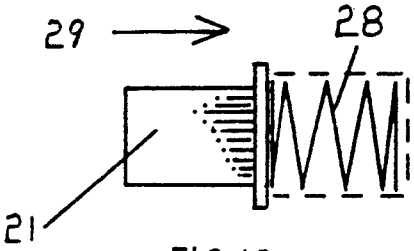
FIG. 10 is a view in side elevation of the roller handle lock (detent)

The roller 24 is approximately as wide as the cooler body to allow for towing over all types of terrain, and to give a secure non-tip tow. It is approximately two and one half inches in diameter (FIG. 8) to make it durable for use.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A portable wheeled cooler apparatus comprising:

a cooler chest including a body having a generally rectangular bottom member, four upright side walls, a top, and a lid covering said top, defining an enclosure;

a roller handle having a first end connected to said cooler chest at a first pair of pivot points located on respective opposing ones of said side walls defining a roller handle axis of rotation;

a tow handle having a first end connected to said cooler chest at a second pair pivot points located on said respective opposing side walls of said chest defining a tow handle axis of rotation;

said roller handle has a roller which covers and is rotatable about a section, located at a second end of said roller handle, parallel to the roller handle axis of rotation;

said roller handle is rotatable about said roller handle axis of rotation from an upper carrying position to a lower wheeled towing position;

said tow handle is rotatable about said tow handle axis of rotation from an upper carrying position, in which a second end of said tow handle is brought together with the second end of the roller handle in its upper carrying position, to an extended towing position; and a lock assembly, located on said opposing side walls, is operable to support the roller handle in its lower position and thereby supporting said wheeled cooler apparatus allowing it to be pivoted about said second end of said roller handle by raising the tow handle.

* * * * *